US005858114A

United States Patent [19]

Board et al.

[11] Patent Number: 5,858,114

[45] Date of Patent: Jan. 12, 1999

[54] METHOD AND APPARATUS FOR CLEANING LIQUID DISPENSING SYSTEMS

[76] Inventors: Alan Edwin Board; Clay McKenzie Kentwell, both of 24 Lucania, St Currumbin Qld, Australia

[21] Appl. No.: 637,622

[22] PCT Filed: Oct. 31, 1994

[86] PCT No.: PCT/AU94/00665

§ 371 Date: May 8, 1996

§ 102(e) Date: May 8, 1996

[87] PCT Pub. No.: WO95/11854

PCT Pub. Date: May 4, 1995

[30] Foreign Application Priority Data

Oct. 29, 1993 [AU] Australia ..... PM2086
Oct. 21, 1994 [AU] Australia ..... PM8933

[51] Int. Cl.[6] ..... B08B 7/04; B08B 9/00; B08B 3/00

[52] U.S. Cl. ..... 134/18; 134/18; 134/27.12; 134/169 C; 134/166 C; 134/22.18; 134/30; 134/37

[58] Field of Search ..... 134/18, 22.11, 134/22.18, 30, 37, 22.12; 137/169 C, 166 C

[56] References Cited

U.S. PATENT DOCUMENTS 4,917,176 4/1990 Shimada et al. ..... 165/95

*Primary Examiner*—Kenneth R. Horlick
*Assistant Examiner*—Joyce Tung
*Attorney, Agent, or Firm*—Shoemaker and Mattare, Ltd

[57] ABSTRACT

A beer supply line is cleaned by forming a closed loop that includes the beer supply line, introducing a cleaning or flushing fluid into the closed loop, and operating valves in the loop to cause the cleaning or flushing fluid to flow through the loop in alternating directions.

17 Claims, 2 Drawing Sheets

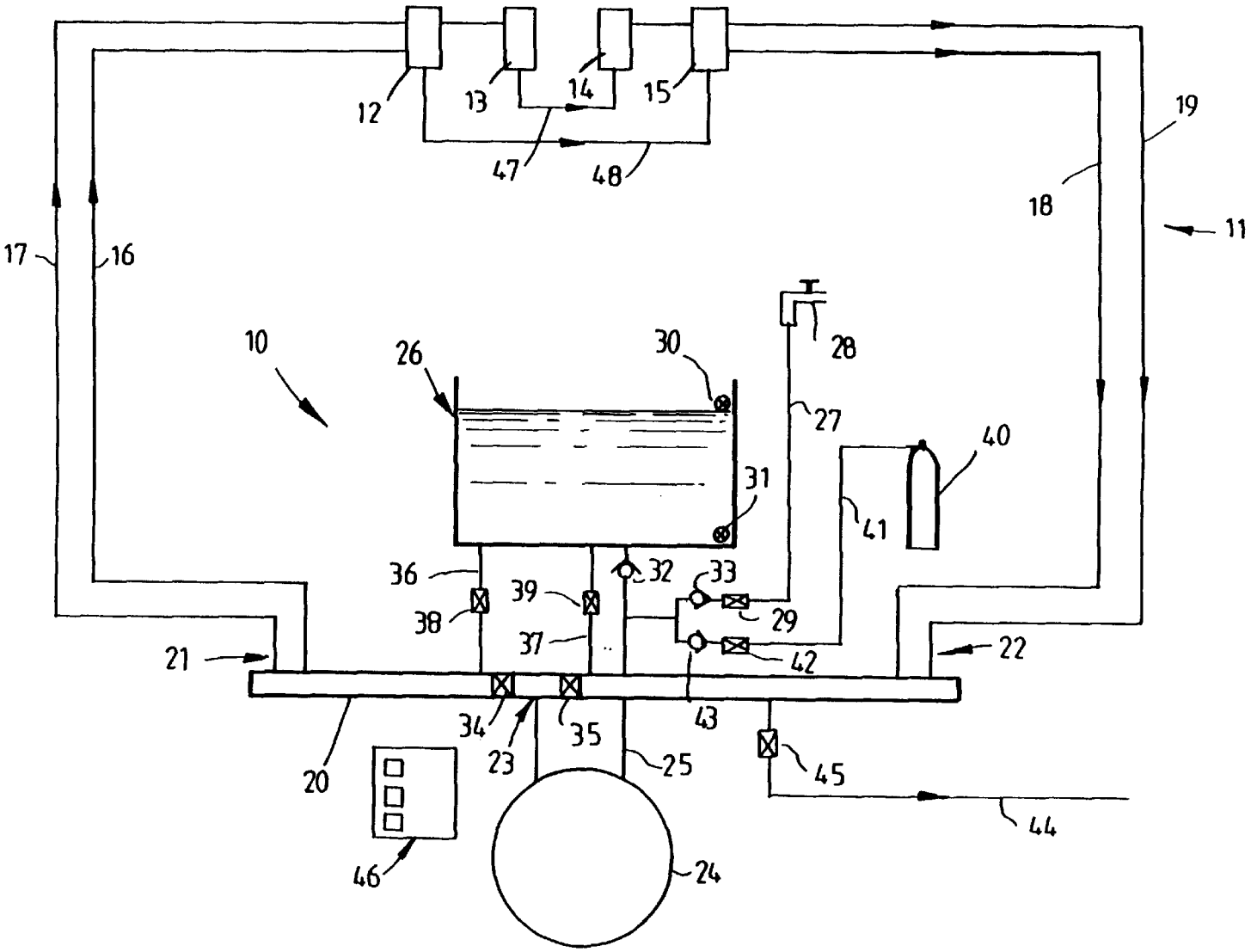
11
19
18
40
22
44
41
28
27
45
42
29
31
33
43
30
32
25
24
15
48
14
35
39
37
47
13
23
34
26
36
38
46
12
20
10
21
16
17

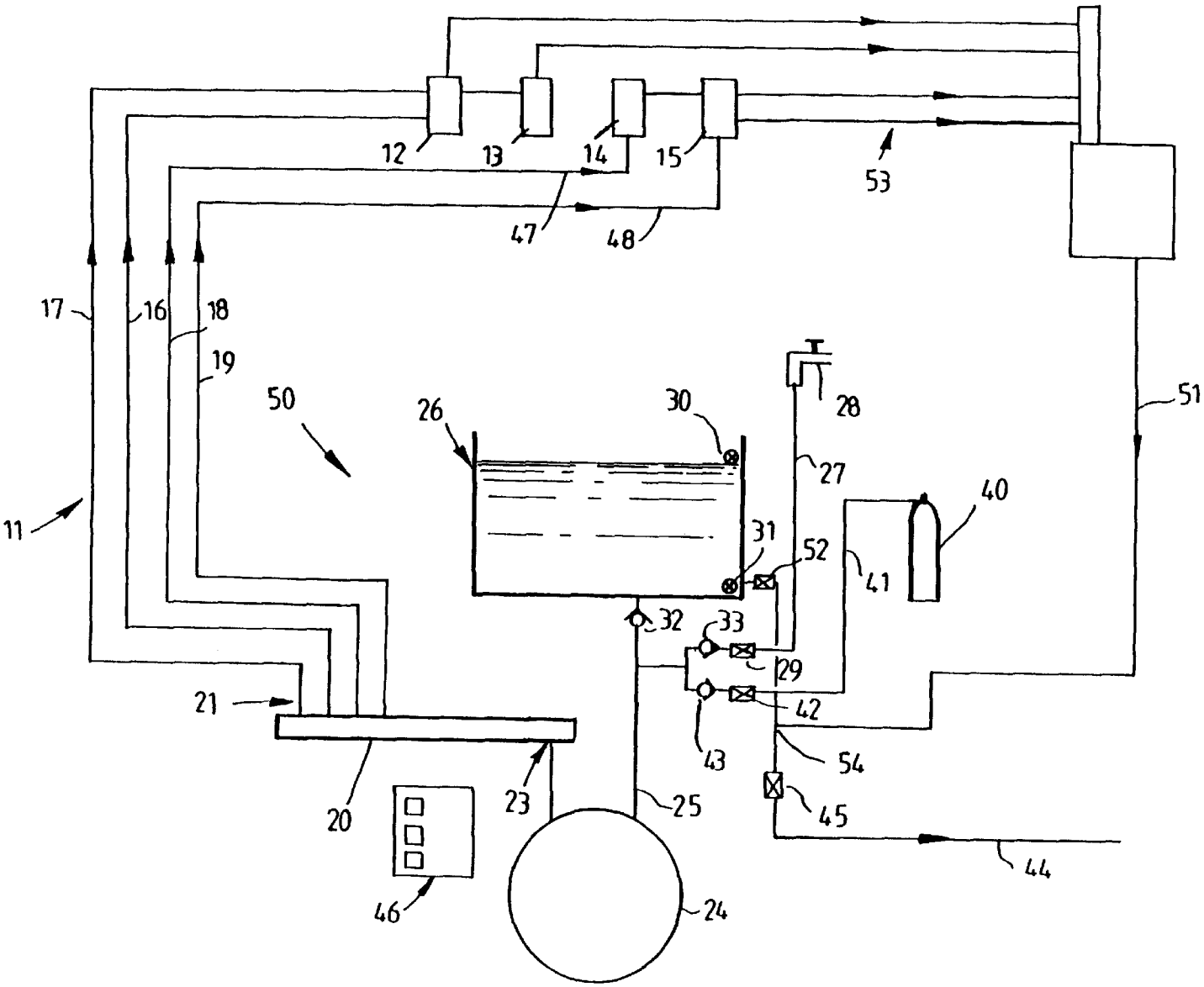
51
44
40
53
41
28
27
52
54
45
42
29
31
33
43
30
32
25
24
15
48
14
47
13
23
26
12
46
20
50
21
18
19
16
17
11

METHOD AND APPARATUS FOR CLEANING LIQUID DISPENSING SYSTEMS

TECHNICAL FIELD

This invention relates to an improved method of and apparatus for cleaning liquid dispensing systems, for example beer dispensing systems as used in hotels or clubs.

BACKGROUND ART

In dispensing systems for beer which are currently used, a large number of couplings, connectors, hoses and pipes are used to convey the beer from kegs to taps which are located at a convenient dispensing position, for example at a bar. Because of the nature of beer, a bacterial yeast tends to grow on the inner walls of the lines and connectors in the direction of beer flow. Such bacterial yeast has proven difficult to remove with normal cleaning methods which generally involve passing cleaning fluids, water and gas through the system in the same direction as the beer flow from the keg or beer source end of the system to the dispensing end of the system and then out to drain. Such methods have been found to be not particularly effective and in many cases the built-up deposits are not fully removed. Other method have involved the soaking of the lines for an extended period of time with a strong caustic solution or detergent with the aim of burning or displacing the yeast growth from the walls of the beer lines and then manually flushing the yeast growth and other impurities to drain with fresh water. This arrangement is not only time consuming but also has not proved to be totally effective.

SUMMARY OF THE INVENTION

The present invention aims to overcome or at least alleviate the above disadvantages by providing a method and apparatus for cleaning liquid dispensing systems and particularly but not exclusively beer dispensing systems which will ensure that bacterial growth is released from the walls of the lines, connectors and associated equipment and flushed from the system in a more efficient manner than the methods used in the prior art. The present invention further aims to provide a method and apparatus which may be effectively and conveniently applied to many different types of liquid dispensing systems for the cleaning thereof. Other objects and advantages of the invention will become apparent from the following description.

The present invention thus provides in a first aspect a method of cleaning a liquid dispensing system of the type including at least one fluid flow line, said method including the steps of introducing a cleaning or flushing fluid into said dispensing system, and causing said cleaning or flushing fluid to flow successively and alternatively in opposite directions in said fluid flow line.

Fluid flowing against the normal flow direction in the case of beer comprises a flow against the normal growth direction of the bacterial yeast resulting in the yeast growth being displaced from the walls of the lines.

The method of the present invention may also include the initial step of flushing any residue liquids, such as beer from the dispensing system to waste prior to passing the cleaning fluid therethrough. The method of the present invention further may include a step of allowing the cleaning or flushing fluid to remain within the liquid dispensing system for a predetermined period of time after the initial cycling operation and thereafter again cycling the cleaning or flushing fluid in opposite directions through the liquid dispensing system. The method of the present invention may further include the step of draining the cleaning or flushing fluids to waste after the above steps and replacing the cleaning fluid with water which is caused to flow in opposite directions as above for rinsing purposes. The system may thereafter be cleared and flushed again with fresh water. At the end of the flushing procedure above, gas may be added to the dispensing system to displace water or other liquid and provide an inert environment to negate any further growth of bacteria until the system is again reused for the dispensing of liquid.

The present invention in a further aspect provides apparatus for cleaning a liquid dispensing system of the type having at least one fluid flow line, said apparatus including means for introducing a cleaning or flushing fluid into said system, and means for causing said cleaning or flushing fluid to flow through said fluid flow line successively and alternatively in opposite directions in said fluid flow line.

The apparatus of the present invention preferably includes pump means whereby the cleaning or flushing fluid may be pumped through the dispensing system in said opposite directions. Preferably, the apparatus includes a header tank for holding a detergent for use as a cleaning fluid in the system. The detergent may comprise a liquid or powder.

A further aspect of the present invention provides apparatus for cleaning a liquid dispensing system of the type having a pair of outlet taps and a fluid flow line connected to each said tap, said lines being connectable to a source of liquid for dispensing through said taps, said apparatus including a fluid manifold, means for connecting each said line to said manifold at spaced apart positions and for connecting said taps whereby to establish a flow loop through said manifold and lines, valve means associated with said manifold, and said manifold being adapted to be connected to a source of cleaning or flushing fluid and means for introducing a cleaning or flushing fluid into said manifold, said valve means being adapted to be operated to cause said cleaning or flushing fluid in use to pass through said flow loop successively and alternatively in opposite directions.

In yet a further aspect, the present invention provides a method of cleaning a liquid dispensing system of the type including at least one fluid flow line, said method including the steps of creating a closed circuit fluid path incorporating said fluid flow line, introducing a cleaning or flushing fluid into said dispensing system and causing said cleaning or flushing fluid to flow through said closed circuit fluid path and thus the fluid flow line.

The flow within the closed circuit created as above physically breaks off the yeast growth from the walls of the beer line or lines to thereby clean the beer lines. The flow of the cleaning or flushing fluid in the closed circuit fluid path may be in either direction in the system.

The present invention further provides apparatus for cleaning a liquid dispensing system of the type having at least one fluid flow line, said apparatus including means for connecting said at least one fluid flow line into a closed circuit fluid path, means for introducing a cleaning or flushing fluid into said system and means for causing said cleaning or flushing fluid to flow through said closed fluid circuit path and thus said at least one fluid flow line.

The apparatus suitably includes a pump for pumping the cleaning or flushing fluid through the circuit and additionally includes a header tank for holding a detergent or other cleaning or flushing fluid for introduction into the system.

BRIEF DESCRIPTION OF THE DRAWINGS

Reference will now be made to the accompany drawings which illustrate schematically embodiments of the invention and wherein:

FIG. 1 illustrates a first form of cleaning apparatus according to the present invention; and FIG. 2 illustrates a second form of cleaning apparatus according to the present invention.

DETAILED DESCRIPTION OF THE PREFERRED EMBODIMENTS

Referring firstly to FIG. 1 there is illustrated cleaning apparatus 10 according to the invention for use in this embodiment in cleaning a beer dispensing system 11, including four dispensing taps 12, 13, 14 and 15 which are supplied from kegs (not shown) through respective supply lines 16, 17, 18 and 19. The apparatus 10 includes a flow control pipe or manifold 20 which has couplings 21 and 22 at each end which are adapted to be connected to the supply lines 16, 17, 18 and 19 and which is further coupled intermediate its ends at 23 to the outlet of a pump 24. The pump 24 has its inlet connected via a line 25 to a header tank 26 to receive a supply of cleaning liquid or water therefrom for pumping through the liquid dispensing system 11 as described further below.

The line 25 is also connected to an inlet line 27 which may be connected to a mains water tap 28. A valve 29 is provided in the inlet line 27 and is actuable by a level sensor 30 to control the level of water within the header tank 26, the level sensor 30 being located at an upper position in the tank 26. Preferably, the valve 29 is a solenoid control valve which is switched off when the sensor 30 which may comprise a float actuated switch senses that the level of liquid within the tank 26 reaches a predetermined level so as to cease supply of water from the tap 28 to the tank 26. A further sensor 31 is provided in the base of the tank 26 to sense when the tank 26 is substantially empty, the sensor 31 being also adapted to control operation of the valve 29 for filling of the tank 26.

A one way valve 32 is provided in the line 25 to prevent flow back to the tank 26 through the line 25. A further one way valve 33 is provided in the line 27 which prevents flow along the line 27 towards the tap 28.

The manifold 20 includes two solenoid control valves 34 and 35 on opposite sides of the connection 23 of the pump 24 to the manifold 20 to control supply of liquid to opposite ends of the manifold 20. Further lines 36 and 37 are connected between the manifold 20 and the tank 26 on opposite sides of the pump connection 23. Fluid flow through the lines 36 and 37 is controlled by respective solenoid actuated valves 38 and 39.

For supplying gas to the system, a gas supply bottle 40 is provided, being connected to the pump inlet line 25 via a line 41 in which is located a solenoid valve 42. A one way valve 43 is also provided in the line 41 to prevent liquid flow towards the bottle 40.

A drain line 44 is also connected via a solenoid valve 45 to the manifold 20 at the same end as the valve 35. Operation of the respective solenoid valves is controlled by a programmable controller 46.

In use connecting ducts 47 and 48 are connected between pairs of dispensing taps 13 and 14, and 12 and 15, respectively at the bar or dispensing position so as to allow for circulation of cleaning and flushing fluids through the full liquid dispensing system as described further below. The connecting ducts 47 and 48 may include boots which are simply pushed on to the ends of the dispensing taps 12, 13, 14 and 15 so as to make the fluid flow connection. The respective supply lines 16, 17, 18 and 19 are detached from their associated kegs and connected to the manifold 20 through any suitable connection arrangement at couplings 21 and 22 so as to establish a flow loop comprising the manifold 20, lines 16 and 17, connected taps 12 and 15, and 13 and 14, and lines 18 and 19. The supply line 27 is also connected to a convenient water mains supply tap 28.

After connection of the system 11 into the apparatus 10 as described above, a cleaning agent such as detergent is deposited into the tank 26 and operation of the programmable controller 46 is initiated. This will cause initially the valve 29 to be opened so that mains water is supplied from the tap 28 through the line 27 to the manifold 20. The valve 34 is opened whilst the valve 35 is shut off so that the mains water flow will pass via the pump 24 (which is not operating) into the manifold 20 along the lines 16 and 17 through the taps 12 and 13 ducts 47 and 48, taps 14 and 15 and back through the lines 18 and 19 to the manifold 20. The valve 45 is also opened by the controller 46 such that the remaining beer within the system 11 is flushed to drain through the line 44. This procedure continues for a time as set by a timer associated with the controller 46 and usually is for a period of approximately five minutes.

When this period has expired, the drain valve 45 is closed and at the same time the valve 38 is opened so that mains water passing into the manifold 20 is directed into the header tank 26 filling same with the water rising to a level determined by the sensor 30. When the water in the header tank 26 reaches that level, operation of the sensor 30 will cause the valve 29 to be shut off and the pump 24 to be started. The liquid and cleaning agent mix in the tank 26 is pumped by the pump 24 through the line 25 into the manifold 20 being blocked by the closed valve 35 but being allowed to pass along the manifold 20 by the previously opened valve 34 so that the cleaning fluid will pass through the lines 16 and 17, lines 47 and 48 which connect the taps 13, 14 and 12, 15 and into the lines 19 and 18 back to the opposite end of the manifold 20 to be returned through the line 37 and valve 39 which has been opened, to the tank 26.

This direction of flow is continued for a predetermined time, in this instance ten minutes, after which time the valve 34 is closed, the valve 35 is opened, the valve 39 closed and the valve 38 opened such that the flow is in the reverse direction through the lines 18 and 19, connected taps 13 and 14 and 12 and 15 through the lines 16 and 17 to the manifold 20 and back through the line 36 and valve 38 to the tank 26. This direction of flow is again continued for a predetermined period of time, preferably ten minutes. The above procedure ensures that the liquid detergent mix is distributed fully throughout the system 11.

At the end of the above cycling procedure, the pump 24 is stopped and the cleaning fluid left within the lines 16, 17, 18 and 19 for a predetermined period of time, so that the lines are soaked. Soaking is continued for an extended period, usually in the region of one hour.

The cycling procedure is then recommenced with the respective valves and pump 24 being operated to circulate the cleaning fluid in a first direction and thereafter in the reverse direction as described above. Preferably this procedure is carried out in short cycles of six seconds in each direction by alternative closing and opening of the valves 34, 35, 38 and 39. At the end of this cycling operation which preferably continues for approximately thirty minutes, the drain valve 45 is opened, and the pump 24 continues operating to pump the cleaning fluid in the tank 26 to drain through the line 44. The level sensor 31 in the bottom of the tank 26, senses when the tank 26 is substantially empty at which point the pump 24 stops operating. Operation of the sensor 31 also opens the valve 29 and closes the valves 35, 38 and 39. Mains water will thus flow from the tap 28 through the valve 29 and pump 24 through the manifold 20 and lines 16, 17, 18 and 19 through the valve 45 to drain line 44. This operation continues for approximately five minutes to rinse through the lines in a forward direction.

The apparatus then commences a rinsing cycle. In this cycle, the valve 29 is opened which allows fresh water from the tap 28 to flow via the valve 29 through the pump 24 into the manifold 20. The valves 34, 35, 38 and 39 are opened which will allow water to flow into the tank 25 until it reaches an upper level as sensed by the sensor 26. This causes the valve 29 to be turned off and the pump 24 to be turned on. At the same time, the valves 35, 38 and 39 are turned off whilst the valves 34 and 45 are turned on so that the water in the tank 26 is pumped through the lines 16, 17, 18 and 19 to drain through the line 44. When the water in the tank 26 drops to a level sensed by the sensor 31 the above process is repeated to ensure complete rinsing of the lines. The procedure continues for a number of times, preferably four.

At the end of the above rinsing operation, the valve 29 is opened along with the valves 34 and 45, whilst the valves 38, 39 and 35 are closed. Mains water thus passes into the pump 24 (which is stopped) and manifold 20 to flow through the lines 16, 17, 18 and 19 and drain valve 45 to the drain line 44. This continues for approximately fifteen minutes.

In the final operation the valve 29 is closed and the valve 42 is opened to enable gas in the cylinder 40 to enter the system 11 so that all the water remaining in the system is pushed to drain through the valve 45 with the gas serving to purge and dry the lines 16, 17, 18 and 19. This continues for a period of approximately two minutes.

The lines 16, 17, 18 and 19 are then reconnected to their kegs and the connecting ducts 47 and 48 are removed to allow the taps 12, 13, 14, and 15 to be used for dispensing from the kegs.

The apparatus 10 described above may be operated in a number of different cycles with the time between cycles and the time within cycles being variable by the processor 46. Alternative valving arrangements may also be provided to effect the cycling operations described above or different cycling operations, operation of the valves being controlled by the processor 46.

Referring now to FIG. 2 there is illustrated a further embodiment of cleaning apparatus 50 according to the present invention which has many features in common with the embodiment of FIG. 1 and wherein like components have been given like numerals. As previously, the liquid dispensing system 11 comprises dispensing taps 12, 13, 14 and 15 say at a bar which are supplied by respective fluid flow lines 16, 17, 18 and 19 from a keg or other beer source. A return line 51 is also provided extending from the region of the taps 12, 13, 14 and 15 and back to the area of the keg or beer source. The apparatus 50 includes as before a manifold 20 to which the beer lines 16, 17, 18 and 19 may be connected and which in this instance is connected to the outlet side of a pump 24 at position 23. The inlet of the pump 24 is connected to a line 25 and via a one way valve 32 to a tank 26 which is provided for introducing cleaning liquid into the system. As previously, the line 25 is connectable to a mains water tap 28 via a line 27 which includes a solenoid valve 29 and one way valve 33. The line 25 is also connectable through a line 41 with a gas source 40, the line 41 also including a solenoid valve 42 and one way valve 43. A drain line 44 is connected to the tank 26 and includes a pair of solenoid valves 45 and 52. Float switches 30 and 31 are provided at the upper and lower levels of the tank 26 respectively. A controller 46, suitably a programmed controller is provided to control operation of the apparatus 50.

In use, the beer supply lines 16, 17, 18 and 19 are detached from their kegs or other beer source and coupled at 21 to the manifold 20. The outlets of the beer taps 12, 13, 14 and 15 are connected through further lines 53 to a common manifold and return line 51 which is connected at 54 to the drain line 44 between the valves 45 and 52.

In an alternative arrangement the taps 12, 13, 14 and 15 may be coupled together as in the embodiment of FIG. 1 and the normal supply lines 18 and 19 used as return lines in place of the line 51 and being connected to the drain line 44 at the point 54.

In initial operation, under the control of the controller 46, the solenoid valve 29 is opened to allow water from the tap 28 to flow through the line 27 and line 25 to the non-operating pump 24 where it passes into the manifold 20 and flows through the lines 16, 17, 18 and 19, taps 12, 13, 14 and 15 and return line 51 back to the drain line 44 in which the valve 45 is opened to allow for preliminary flushing of old beer and residue from the system to drain for a short period of time, for example five minutes.

After this time, the solenoid valve 52 is opened and solenoid 45 is closed to permit water to flow into the tank 26. A detergent is added to the tank 26 before this occurs. When the float switch 30 operates to indicate that the tank 26 is substantially full, the solenoid valve 29 is caused to close and operation of the pump 24 is initiated. This causes the detergent mixture to be pumped from the tank 26 through the lines 16, 17, 18 and 19 and taps 12, 13, 14 and 15 to be returned via the line 51 and valve 52 to the tank 26. During this procedure the solenoid valve 52 may be opened and closed to cause agitation in the lines and assist in the cleaning process.

After the above cleaning cycle is finished, the solenoid valve 52 is closed and the solenoid valve 45 is opened. This will cause the tank 26 to be emptied by the pump 24 through the lines 16, 17, 18, 19 and line 51 via the drain line 44. When the float switch 31 senses the tank 26 be substantially empty, it will be actuated to cause the solenoid valve 29 to again open and the pump 24 to stop operating. Fresh water will thus flow from the tap 28 through the pump 24 and the dispensing system 11 to drain 44 through the open valve 45. This flushing procedure is continued for a predetermined time, usually in the region of thirty minutes.

The tank 26 is then flushed with clean water by opening of the solenoid valve 52 and closing of the solenoid valve 45. When the float switch 30 is activated the solenoid valve 29 is closed and the drain solenoid valve 45 opened and the pump 24 is activated to empty the tank 26 until the float switch 31 registers that the tank 26 is substantially empty. This procedure is preferably repeated a number of times.

The dispensing system is now full of fresh clean water and the solenoid valve 42 is then opened and the valve 52 closed so that gas from the gas supply 40 will displace water from the dispensing system 11 to drain by its own pressure for a predetermined time of say three minutes. At the end of this period, the valve 45 can be closed to leave the dispensing system 11 dry and filled with inert gas until required for normal use.

Whilst the above has been given by way of illustrative embodiment of the invention, all such modifications and variations thereto as would be apparent to persons skilled in the art are deemed to fall within the broad scope and ambit of the invention as herein defined in the appended claims.

We claim:

1. A method of cleaning a beer dispensing system of the type including at least one beer supply line for supplying beer to dispensing means, said method including forming a closed circuit flow loop by connecting said at least one beer supply line in a closed circuit flow loop including control valve means, introducing a cleaning or flushing fluid into said flow loop, and operating said control valve means to cause said cleaning or flushing fluid to flow successively and alternatively in opposite directions in said closed circuit flow loop.

2. The method of claim 1 and including an initial step of flushing any residue liquids from said beer dispensing system to waste prior to introducing said cleaning fluid into said flow loop.

3. The method of claim 1 or claim 2 and including a further step of allowing said cleaning or flushing fluid to remain within said flow loop for a predetermined period of time and thereafter again operating said control valve means to cause said cleaning or flushing fluid to flow in opposite directions through said flow loop.

4. The method of claim 3 and further including the step of draining said cleaning or flushing fluid to waste, replacing said cleaning fluid with water and operating said control valve means to cause said water to flow in opposite directions through said flow loop for rinsing purposes.

5. The method of claim 4 and including a subsequent step of adding gas to said flow loop to displace water or other liquid therefrom.

6. The method of claim 1 wherein said beer dispensing system includes a pair of beer supply lines for supplying beer to respective said dispensing means, said method including the steps of interconnecting said beer supply lines in series in said flow loop and causing, by operating said control valve means, said cleaning or flushing fluid to flow through said flow loop and said beer supply lines successively and alternatively in opposite directions.

7. Apparatus for cleaning a beer dispensing system of the type having at least one beer supply line for supplying beer to dispensing means, said apparatus including means for connecting said beer supply line in a closed circuit flow loop, means for introducing a cleaning or flushing fluid into said flow loop, and control valve means for causing said cleaning or flushing fluid to flow through said flow loop and said beer supply line successively and alternatively in opposite directions.

8. Apparatus according to claim 7 and including pump means whereby said cleaning or flushing fluid may be pumped through said flow loop in said opposite directions.

9. Apparatus according to claim 8 and including a header tank for a cleaning fluid for introduction into said flow loop.

10. Apparatus according to any one of claims 7 to 9 wherein said control valve means including a plurality of fluid flow valves, said valves being selectively actuable to control the direction of flow of said cleaning or flushing fluid through said flow loop.

11. Apparatus according to claim 7 wherein said beer dispensing system includes a pair of beer supply lines, said beer supply lines being interconnectable in series and connectable with said apparatus to define said flow loop through which said cleaning or flushing fluid is caused to flow successively and alternatively in opposite directions.

12. Apparatus for cleaning a beer dispensing system of the type having a pair of outlet taps and a beer supply line connected to each said tap, said lines being connectable to a source of beer for dispensing through said taps, said apparatus including a fluid manifold, means for connecting each said line to said manifold at spaced apart positions and for interconnecting said taps whereby to establish a closed circuit flow loop through said manifold and lines, control valve means associated with said manifold, and means for introducing a cleaning or flushing fluid into said manifold, said control valve means being adapted to be operated to cause said cleaning or flushing fluid to pass through said flow loop successively and alternatively in opposite directions.

13. Apparatus according to claim 12 and including a pump connected to said manifold for pumping said cleaning or flushing fluid through said flow loop.

14. Apparatus according to claim 11 and including a holding tank for holding said cleaning or flushing fluid, said pump being connectable to said holding tank to pump said cleaning or flushing fluid through said flow loop.

15. Apparatus according to claim 10 wherein the control valve means includes four fluid flow valves operatively connected to control the direction of fluid flow within the closed circuit flow loop.

16. Apparatus according to claim 13 wherein the means for introducing a cleaning or flushing fluid into said manifold includes a tank.

17. Apparatus according to claim 16 wherein the control valve means includes first and second fluid flow valves spaced apart on the manifold and third and fourth fluid flow valves on respective return flow connections between the tank and the manifold, each said return flow connection being connected to the manifold between the first or second fluid flow valves and respective ends of the manifold, the pump being connected to the manifold between the first and second fluid flow valves, the pump is also connected to the tank by an outflow connection, said fluid flow valves being operatively connected to cause said cleaning or flushing fluid to pass through said closed circuit flow loop successively and alternatively in opposite directions.

* * * * *